United States Patent [19]

Anguelo et al.

[11] Patent Number: 5,018,320

[45] Date of Patent: May 28, 1991

[54] STRIPPER ASSEMBLY FOR COMBUSTION CHAMBERS OF TURBINE OR JET ENGINES

[76] Inventors: Michael Anguelo; George Angulo, both of 2358 W. Eighth La., Hialeah, Fla. 33010

[21] Appl. No.: 308,298

[22] Filed: Feb. 9, 1989

[51] Int. Cl.[5] ..... B24C 3/00

[52] U.S. Cl. ..... 51/426; 51/419; 51/424

[58] Field of Search ..... 51/410, 426, 411, 417, 51/419, 421, 424

[56] References Cited

U.S. PATENT DOCUMENTS

| | | | |
|---|---|---|---|
| 1,522,159 | 1/1925 | Vollmer | 51/426 |
| 1,605,730 | 11/1926 | Hoevel | 51/426 |
| 1,628,317 | 5/1927 | Hoevel | 51/426 |
| 1,887,395 | 11/1932 | Billings | 51/426 |
| 2,590,819 | 3/1952 | Huyett | 51/426 |
| 2,601,746 | 7/1952 | Clark | 51/426 |
| 3,270,464 | 9/1966 | Bowling | 51/426 |
| 3,545,137 | 12/1970 | Vrana | 51/426 |

*Primary Examiner*—Frederick R. Schmidt
*Assistant Examiner*—Blynn Shideler
*Attorney, Agent, or Firm*—Malloy, Downey & Malloy

[57] ABSTRACT

An assembly for the cleaning of the exterior and interior surfaces of combustion chambers of the type found in gas turbine and jet engines incorporating the use of an automatically positionable spray assembly having blast madia of desired grit size issuing under pressure therefrom to impinge upon exposed surfaces of the combustion chamber thereby stripping away any thermal oxidation, carbon deposits and thermal coatings in an automatic, accurate and efficient manner.

13 Claims, 2 Drawing Sheets

STRIPPER ASSEMBLY FOR COMBUSTION CHAMBERS OF TURBINE OR JET ENGINES

BACKGROUND OF THE INVENTION

1. Field of the Invention

This invention relates to an assembly incorporating a sandblasting type structure which is automatically positioned relative to the exposed surface portions of a combustion chamber of the type used in gas turbine engines and jet engines for the removal of contaminants or deposits formed on the exterior and interior surface of the combustion chamber.

2. Description of the Prior Art

Both gas turbine engines and jet engines incorporate a combustion chamber therein. Such combustion chamber generally has an elongated configuration and comprises heat resistant coatings formed on exposed surface areas thereof. Under normal operating conditions, the combustion chamber is of course exposed to extreme heat conditions. The exposed surfaces of such chambers accordingly become contaminated by the formation of thermal oxidation, carbon deposits, thermal barrier coatings, etc. thereon.

In an effort to prolong the operable life of such gas turbine and jet engines, it is possible to clean or strip away the damaged surface coatings which include the above noted contaminants and resurface such chambers for replacement and reuse in the aforementioned gas turbine and jet engines.

While the above noted stripping procedure is generally recognized in the prior art, there appears to be a lack of an efficient process and/or apparatus to accomplish the effective and rapid cleaning of exposed surface portions of combustion chambers of the type set forth herein in an economic manner.

One method and associated apparatus adaptable for the effective cleaning of such exposed surfaces include sandblasting techniques or the direction and impingement of blast media such as sand or any applicable particulate material of a preferred grit size directed under pressure continuously over the exposed surface portions to be cleaned. In order to accomplish the above cleaning process in an effective manner, the apparatus must be specifically structured and adapted to continuously cover the exposed surfaces preferably in an automatic manner within a given time period which renders the entire process both reliable and economically feasible.

Accordingly, there is a need for a cleaning apparatus or assembly of the type preferably utilizing the direction of particulate blast media onto exposed surface portions of combustion chambers to be cleaned or stripped wherein a spray nozzle assembly is automatically positionable relative to the surface in a quick, efficient and reliable manner.

SUMMARY OF THE INVENTION

This invention relates to a stripping or cleaning assembly particularly adapted for the cleaning of exposed surface portions of combustion chambers. The type of combustion chambers referred to herein is utilized in jet engines or gas turbine engines. In the normal operation of these types of engines, the combustion chamber is of course subjected to extremely high temperatures. Continued use results in the formation of thermal oxidation, carbon deposits, thermal barrier coatings, etc. on the interior or exposed surface portions of said combustion chambers thereby rendering the engines inoperative or their operation less than totally efficient. The prior art, however, has recognized that the stripping or removal of the above noted contaminants from the exposed surface portions of the combustion chambers can be accomplished and the combustion chambers can therefore be effectively rebuilt for replacement in the aforementioned gas turbine or jet engines for reuse.

The assembly of the present invention comprises a housing having a substantially hollow interior and being of sufficient dimension to enclose at least one of the combustion chambers in an operative position therein. A spray nozzle assembly is movably mounted on the interior of the housing in direct relation to exterior portions of the combustion chamber. The spray nozzle assembly includes a plurality of nozzle members each of which communicate with a supply of particulate blast media of any applicable or preferred grit size. The housing may be further structured to include a collection facility for the collection of the particles of the blast media after such particles strike the exposed surface of the combustion chamber. Once recollected, these particles may be effectively recirculated back to the spray nozzle assembly for reuse. Further, a supply of pressurized air serves to aid in the recirculation or initial supply of the particles of the blast media to the spray nozzle assembly wherein a preferred pressure is in the range of approximately 60 pounds p.s.i.

An important feature of the present invention is the inclusion of a first and second drive means mounted on the housing. The first drive means includes a drive motor and an elongated drive assembly. The drive assembly includes an elongated shaft having its distal or innermost end secured to the plurality of nozzle members for selective and automatic positioning thereof on the interior of the housing relative to the exposed surfaces of the combustion chamber to be cleaned. More particularly, the placement of the plurality of spray nozzle is such as to collectively surround the exposed surface being cleaned. Further, the interconnection of the spray nozzle assembly to the first drive means serves to continuously and reciprocally move the spray nozzles, linearly along the length of the exposed surface being cleaned such that the particles of the blast media are continuously directed onto the surface to be cleaned.

A second drive means is provided in driving relation to a chamber mounting assembly. The mounting assembly is disposed on the interior of the housing in supporting engagement with the combustion chamber so as to operatively position the chamber relative to the aforementioned spray nozzle assembly. The second drive means also includes a drive motor which serves to continuously rotate the mounting assembly and of course the combustion chamber thereon.

As will be more apparent hereinafter, the intended operation of both the first and second drive means serves to continuously rotate the combustion chamber within the housing while simultaneously allowing linear and reciprocal movement of the plurality of spray nozzles along the length of the combustion chamber between opposite ends thereof. Concurrently, the particles of the blast media issue under pressure from the nozzle members thereby serving to efficiently and effectively cover the entire exposed surface with the blast media causing stripping away of any harmful deposits or like contaminants therefrom.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which:

FIG. 6 is a detailed view in partial cutaway showing structural features of a switch assembly directed to the regulation of movement of certain internal components of the present invention.

Like reference numerals refer to like parts throughout the several views of the drawings.

DETAILED DESCRIPTION OF THE PREFERRED EMBODIMENT

Figure 1:
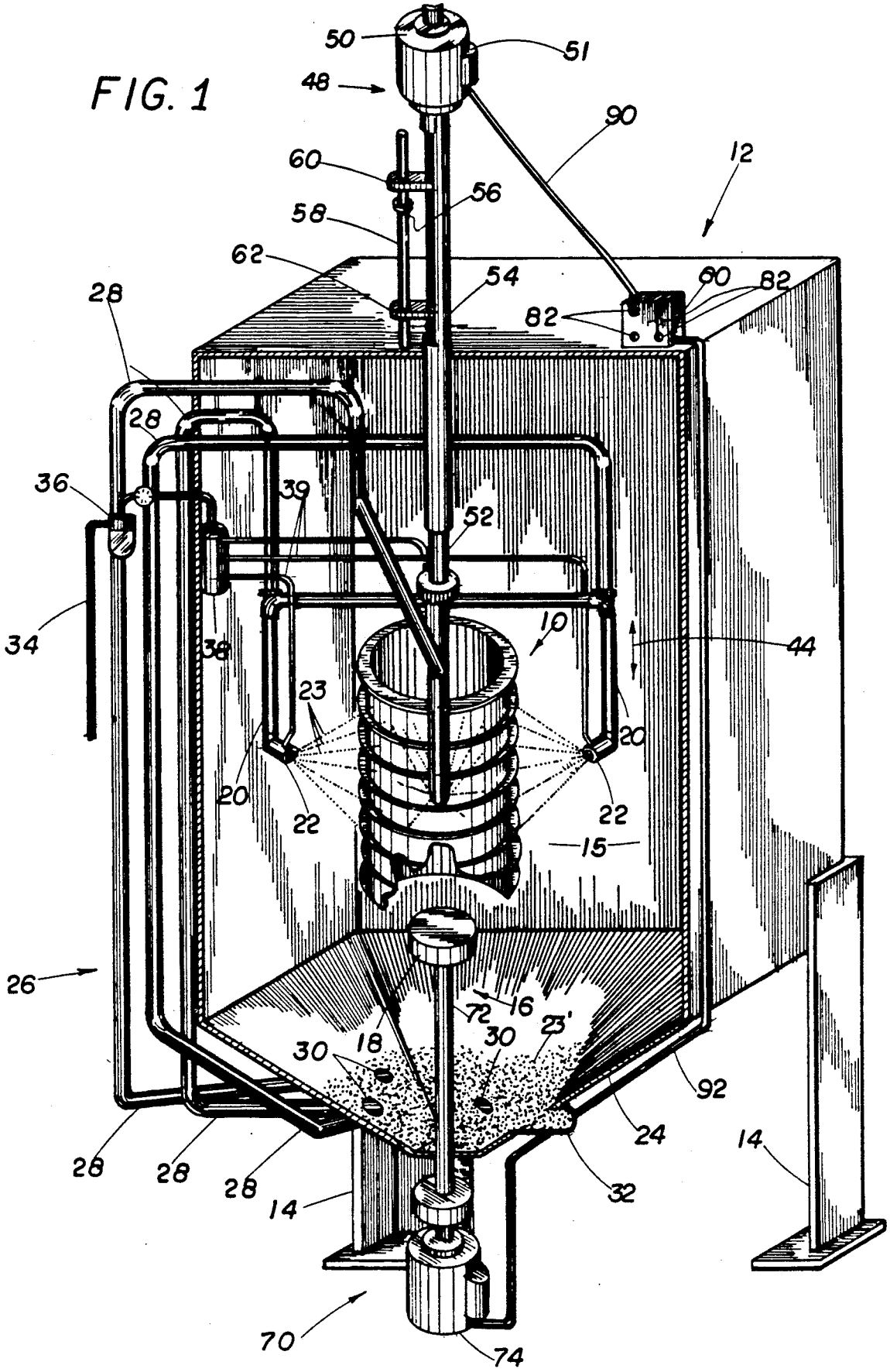
FIG. 1 is a perspective view in partial cutaway and section showing details of the assembly of the present invention.
Figure 2:
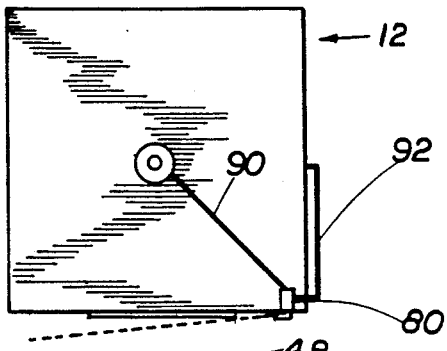
FIG. 2 is a top plan view of the embodiment of FIG. 1.

As shown in FIG. 1, the present invention comprises a cleaning assembly for the stripping or cleaning of exposed surfaces of combustion chambers of the type generally indicated as 10 associated with gas turbine engines or jet engines. The operative position for the combustion chamber 10 during its cleaning or stripping is on the interior of a housing generally indicated as 12. The housing may be supported on any type of applicable support surface by support means, legs, etc., indicated as 14. Further, the housing 12 may take any of a variety of configurations providing a proper interior space as at 15 is provided to house the chamber 10 on a mounting assembly generally indicated as 16. The mounting assembly and more specifically a mounting platform 18 may take any of a variety of applicable configurations and sizes such that the combustion chamber 10 is secured thereon for continuous rotational movement as will be explained in greater detail hereinafter.

An important feature of the present invention is the existence of a spray nozzle assembly comprising a plurality of nozzle members 20 disposed in spaced apart relation to one another and collectively disposed in surrounding relation to the combustion chamber 10 when it is operatively supported on the support platform 18 of the support or mounting assembly 16. Each of the nozzles 20 includes a spray or nozzle head 22 specifically structured and adapted to serve as a sandblasting nozzle allowing blast media, such as sand 23, to issue therefrom so as to impinge on exposed surfaces of the combustion chamber 10 as depicted in FIG. 1.

The base as at 24 of the housing 12 may serve as a supply collector or reservoir for blast media or sand 23'. The particles defining the blast media 23 or 23' collects in the bottom of the housing as shown in FIG. 1 and may be returned or recycled back to the plurality of nozzle members 20 for reuse as such particles issue from the nozzle heads 22. Recirculation is accomplished by transfer means generally indicated as 26 in the form of a plurality of conduits 28 and 39 the interior of which are under negative pressure. Entrances to each of the conduits 28 are disposed in cooperative relation to the supply or reservoir of particulate material 23' as at 30. Accordingly, the particulate material is "sucked" from the base 24 defining the collection reservoir, passed up through the interior of the conduits 28 and 39 and back to separate ones of the nozzle members 20 as shown. Further, a particulate or blast media supply is indicated as at 32 serving to fill or refill particles 23 and 23' as needed. Pressurized air, preferably at a pressure of approximately 60 p.s.i. is supplied through an air supply conduit as at 34 through a filter 36 and into a dispersion head 38 which is included in the transfer means. A plurality of individual conduits or pipes 39 of the transfer means serve to supply the individual nozzle or spray heads 22 for the issuance of the particulate blast media under pressure as is common in sandblasting techniques. The supply of pressurized air issuing into the housing to the spray assembly may be supplied from any type of high pressure air supply or compressor (not shown for purposes of clarity). It should be emphasized that the spray nozzle assembly, including each of the nozzle members 20, moves reciprocally and vertically along the length of the combustion chamber 10 in the direction indicated by directional arrow 44. Thereafter, all of the conduits 28 and pipes or conduits 39 transferring both the particulate blast media as well as the pressurized air, respectively to the nozzle assembly are formed of a flexible material. This allows movement of the various conduits and nozzles with the nozzle assembly as it reciprocates vertically back and forth along the length of the combustion chamber 10 between opposite ends thereof. Such reciprocal, linear movement is accomplished by a first drive means generally indicated as 48 including a drive motor 50 and an internal drive shaft 52 housed within a protective sheath or the like 54. The drive motor may serve to drive, for example, a pinion gear first in one direction and then the other. Such pinion gear (not shown) may cooperate with a rack-type gear formed along an upper length of the drive shaft 52 mounted at least in part within the casing of the motor 50 and/or within the sheath 54. Therefore, continuous rotation of the pinion gear, at least partially disposed within the housing of the motor 50 as well as an outer extension thereof as at 51, causes a linear travel of the drive shaft 52 due to interaction of the rack and pinion gears as generally set forth above. The motor 50 is of course electrically powered and is reversibly driven such that rotation of the pinion gear occurs first in one direction and then the opposite direction resulting in vertical, linear travel of all of the nozzle members 20 collectively in the opposite directions indicated by directional arrow 44. A limit switch assembly is disclosed in FIG. 1 schematically and in more detail in FIG. 6. The limit switch assembly includes a limit activating switch 56 mounted on switch guide 58 itself movable between stop members 60 and 62. Contact of the limit switch member 56 with either of the stops 60 and 62 serves to reverse the direction of rotation of the pinion gear or other like drive member by virtue of causing the drive motor 50 to stop rotating in one direction and begin rotating in the opposite direction. Reciprocal travel of the switch member 56 with the guide 58 and between the stop elements 60 and 62 continuously will cause continuous vertical and reciprocal motion of the nozzle members collectively relative to the exterior or exposed surface of the combustion chamber 10 along the length thereof.

A second drive motor is generally indicated as 70 and includes a rotational drive shaft 72 having one end attached to the mounting platform or like 18 to which the combustion chamber 10 is secured. Accordingly, rotation of the drive motor 74, through proper gearing or like drive members, causes continuous rotation of the drive shaft 72, mounting platform 18 and of course the combustion chamber 10 mounted thereon.

It should be readily apparent therefor that simultaneous activation of the first drive means 48 and the second drive means 70 will cause continuous rotation of the combustion chamber 10 concurrently with the linear and reciprocal travel of the plurality of nozzle members 20, relative thereto, thereby allowing the particulate blast media 23 issuing from the spray heads 22 to cover the entire exposed surface of the combustion chamber 10 serving to clean or strip it of any contaminants as set forth above.

Figure 8:
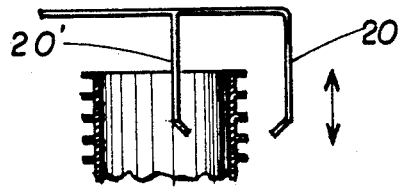
FIG. 8 is a sectional view in partial cutaway showing details of yet another embodiment of the present invention wherein both exterior and interior surfaces are of a given combustion chamber structure are being concurrently cleaned.

Yet another embodiment of the present invention which can be readily incorporated as that shown above is shown in FIG. 8. More particularly, exterior nozzle 20 and interior nozzle 20' reciprocate along the walls both exteriorly and interiorly of a given combustion chamber 10 so as to concurrently strip or clean both exterior and interior surfaces of the combustion chamber 10.

A control box 80 including a plurality of activatable push-button switches 82 is connected to both the first and second drive means 48 and 70 and more particularly the drive motors 50 and 74 respectively through respectively positioned conductor means 90 and 92.

Figure 4:
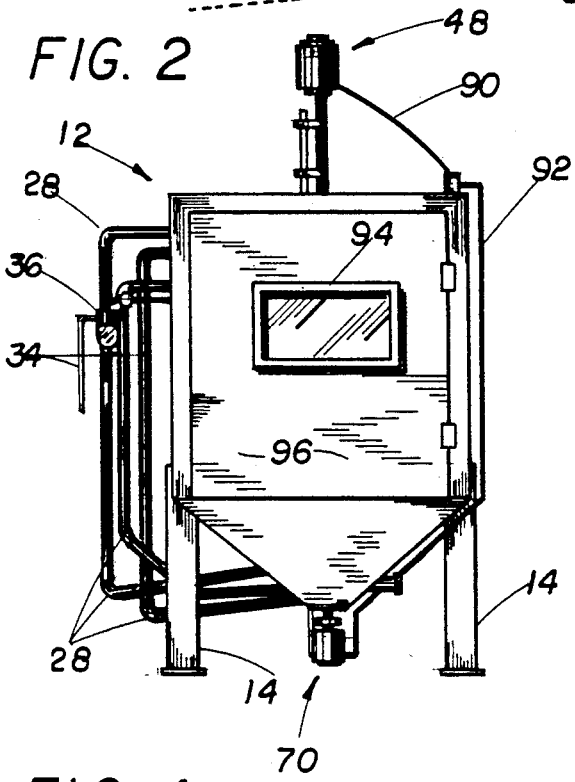
FIG. 4 is a front view of the embodiment of FIG. 1.
Figure 3:
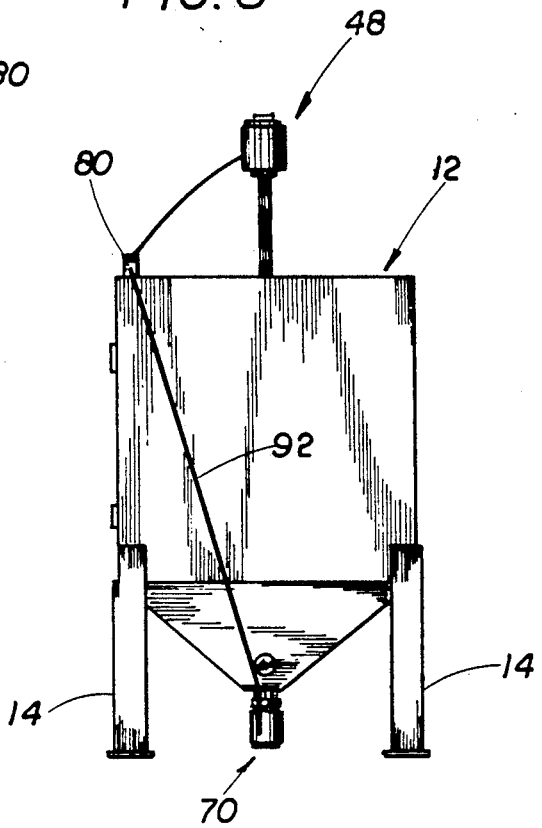
FIG. 3 is a rear view of the embodiment of FIG. 1.
Figure 5:
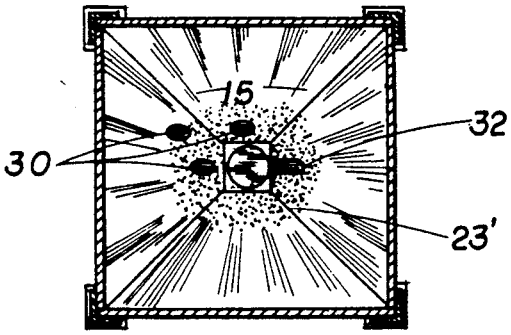
FIG. 5 is a sectional view showing interior details of the embodiment of FIG. 1.
Figure 7:
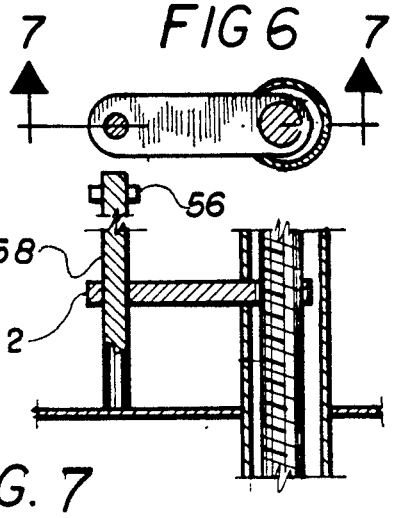
FIG. 7 is a detailed view in partial cutaway and section showing details of a portion of the embodiment of FIG. 6 along line 7—7 thereof.

Other features of the present invention include the housing 12 having a viewing window as at 94 which may be secured to or formed on an access door 96 or other wall of housing 10 as best shown in FIG. 4.

Now that the invention has been described,

We claim:

1. A cleaning assembly for combustion chambers of gas turbine and jet engines designed to direct blast media under high pressure air onto surfaces of the combustion chamber being cleaned, said assembly comprising:

a. a housing including a hollow interior dimensioned to enclose the combustion chamber and including a mounting structure disposed and structured to support the chamber within said hollow interior, b. a spray nozzle assembly mounted within said housing and including a plurality of nozzle members disposed in spaced relation to one another and collectively in surrounding relation to exterior and interior surface portions of the chamber, whereby blast media is directed onto the exterior and interior surface portions, c. transfer means mounted on said housing and connected to said spray nozzle assembly for directing the blast media under pressurized fluid flow to said spray nozzle assembly, d. a first drive means including a drive motor connected to said spray nozzle assembly and structured for reciprocating linear movement of said plurality of spray nozzles within said housing and along a length of the chamber being cleaned, 3. a second drive means including a drive motor connected to said mounting structure and structured for rotation of said mounting structure and the combustion chamber mounted thereon within said housing and relative to said spray nozzle assembly, f. said first drive means comprising an elongate shaft connected at one end to said first drive motor and an opposite end connected to said plurality of spray nozzle members, and g. said first drive means further comprising a limit switch means electrically connected to said first drive motor and further comprising a limit switch assembly including a switch guide movable with said shaft and having a switch terminal mounted thereon, said switch means including a pair of second switch terminals spaced apart form one another and disposed in interruptive engagement relative to said first switch terminal, whereby said first drive motor is reversed in direction of operation upon said first switch terminal successively contacting opposite ones of said second switch terminals.

2. An assembly as in claim 1 further comprising a collecting chamber disposed within said housing in receiving relation to blast media issuing from said spray nozzle assembly and impinging off the chamber exterior and interior surface portions.

3. An assembly as in claim 2 wherein said transfer means comprises a conduit assembly interconnecting collected blast media to said spray nozzle assembly, said collecting chamber and blast media collected therein defining a supply of blast media being continuously delivered to said spray nozzle assembly.

4. An assembly as in claim 3 wherein said transfer means comprises a supply of pressurized air connected to said spray nozzle assembly and in fluid communication with said conduit assembly and the blast media flowing therethrough.

5. An assembly as in claim 1 wherein said spray nozzle assembly comprises each of said plurality of nozzle members including an elongated pipe having a proximal end connected to said transfer means and a distal end connected to a spray head.

6. An assembly as in claim 5 wherein said nozzle members extend along the length of the chamber in outwardly spaced, substantially parallel relation to the chamber and one another.

7. An assembly as in claim 1 wherein said drive motors of said first and second drive means are each mounted exteriorly of said housing and are respectively connected to said spray nozzle assembly and said chamber mount structure interiorly of said housing.

8. An assembly as in claim 7 wherein said drive motor of said first drive means comprises a reversible drive electrically powered motor.

9. An assembly as in claim 1 wherein said first and second drive assembly and said limit switch assembly are cooperatively structured to concurrently rotate said chamber mount and the chamber mounted thereon and linearly reciprocate said spray nozzle members along the length of the chamber.

10. An assembly as in claim 1 wherein said housing includes a viewing window formed in an exterior wall thereof and disposed to allow viewing of the chamber within said housing.

11. A cleaning assembly for combustion chambers of gas turbine and jet engines designed to direct blast media under high pressure air onto surfaces of the combustion chamber being cleaned, said assembly comprising:

a. a housing including a hollow interior dimensioned to enclose the combustion chamber and including a mounting structure disposed and structured to support the chamber within said hollow interior, b. a spray nozzle assembly mounted within said housing and including a plurality of nozzle members disposed in spaced relation to one another and collectively in surrounding relation to exterior and interior surface portions of the chamber, whereby blast media is directed onto the exterior and interior surface portions, c. transfer means comprising flexible conduit means mounted on said housing and including flexible conduit means extending into the housing and being connected to said spray nozzle assembly for directing the blast media under pressurized fluid flow to said spray nozzle members, d. a first drive means including a drive motor connected to said spray nozzle assembly and structured for reciprocating linear movement of said plurality of spray nozzles within said housing and along a length of the chamber being cleaned, e. a second drive means including a drive motor connected to said mounting structure and structured for rotation of said mounting structure and the combustion chamber mounted thereon within said housing and relative to said spray nozzle assembly, and f. said flexible conduit means extending into the housing and to each nozzle member accommodating said reciprocating linear movement.

12. A cleaning assembly as set forth in claim 11 further comprising a collecting chamber disposed within said housing in receiving relation to blast media issuing from said spray nozzle assembly and impinging off the chamber exterior and interior surface portions.

13. A cleaning assembly as set forth in claim 11 wherein said first drive means comprises an elongate shaft connected at one end to said drive motor and an opposite end connected to said plurality of spray nozzle members.

* * * * *